United States Patent [19]

Lems et al.

[11] 4,079,667

[45] Mar. 21, 1978

[54] METHOD OF FORMING AND TENSIONING A STRAP LOOP ABOUT A PACKAGE

[75] Inventors: Peter Lems, Wilmette; Nelson Cheung, Arlington Heights, both of Ill.

[73] Assignee: Signode Corporation, Glenview, Ill.

[21] Appl. No.: 752,001

[22] Filed: Dec. 20, 1976

[51] Int. Cl.[2] ..... B65B 13/02

[52] U.S. Cl. ..... 100/2; 100/26

[58] Field of Search ..... 100/2, 6, 26, 29, 33 R, 100/33 PB; 53/198 B; 156/157

[56] References Cited

U.S. PATENT DOCUMENTS

| | | | |
|---|---|---|---|
| 3,146,694 | 9/1964 | Staron | 100/2 |
| 3,442,735 | 5/1969 | Stensaker | 100/2 X |
| 3,566,778 | 3/1971 | Vilcins | 100/2 |
| 3,691,939 | 9/1972 | Goodley | 100/2 |
| 3,916,779 | 11/1975 | Gutjahr | 100/26 |

FOREIGN PATENT DOCUMENTS

| | | | |
|---|---|---|---|
| 391,013 | 12/1973 | U.S.S.R. | 100/2 |

*Primary Examiner*—Edward J. McCarthy
*Attorney, Agent, or Firm*—Dressler, Goldsmith, Clement, Gordon & Shore, Ltd.

[57] ABSTRACT

A method is disclosed for forming, tensioning and sealing a strap loop about a package and then severing the sealed loop from the trailing length of strap. A length of strap is fed in one direction and the strap free end is guided or moved to form a small primary strap loop with the strap free end overlapping a portion of the loop. The strap free end is then restrained while the standing part of the loop is continued to be fed to expand the loop to a larger predetermined diameter. The expanded loop and/or package is then moved so that the package is encircled by the loop, after which the loop is tensioned tight about the package. A joint connection or seal is next made in the loop and the trailing length of strap is severed from the loop.

25 Claims, 22 Drawing Figures

Fig. 1
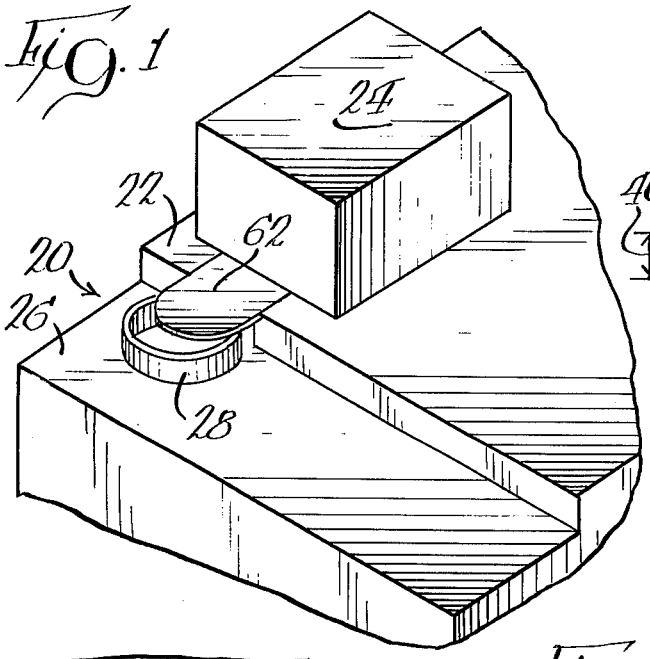
Fig. 3
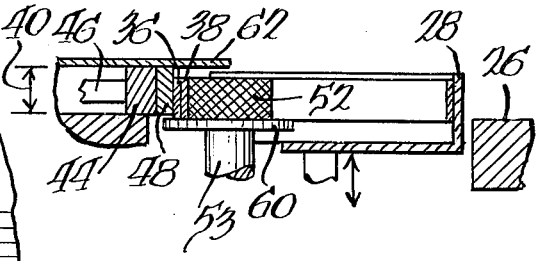
Fig. 2
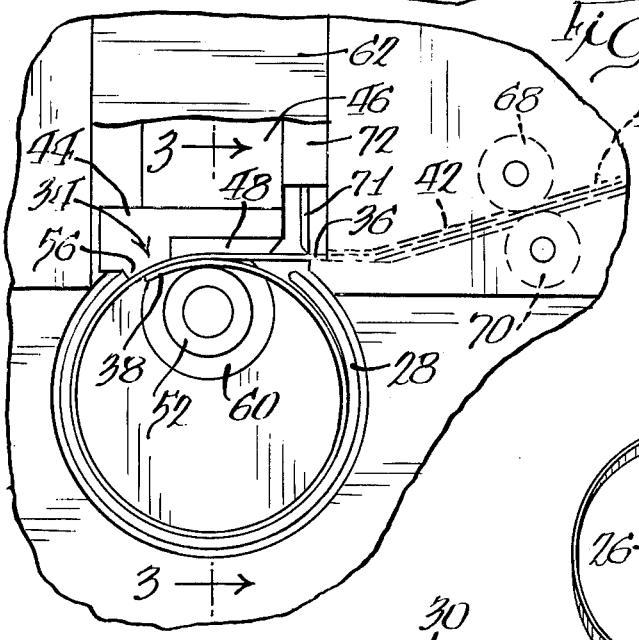
Fig. 4
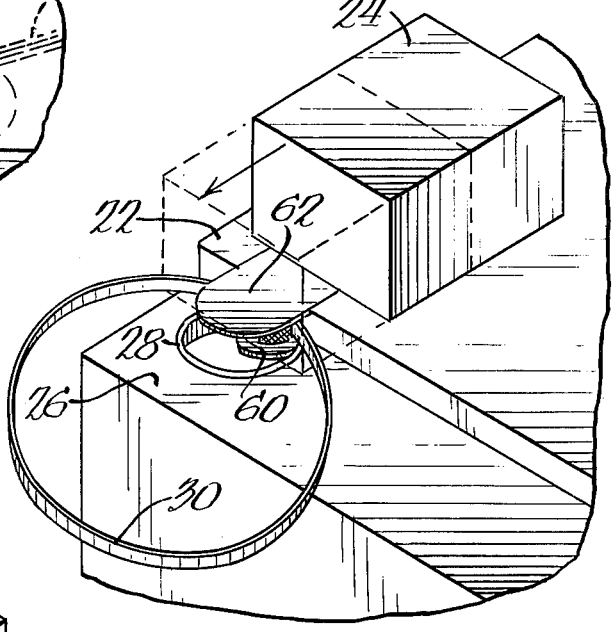
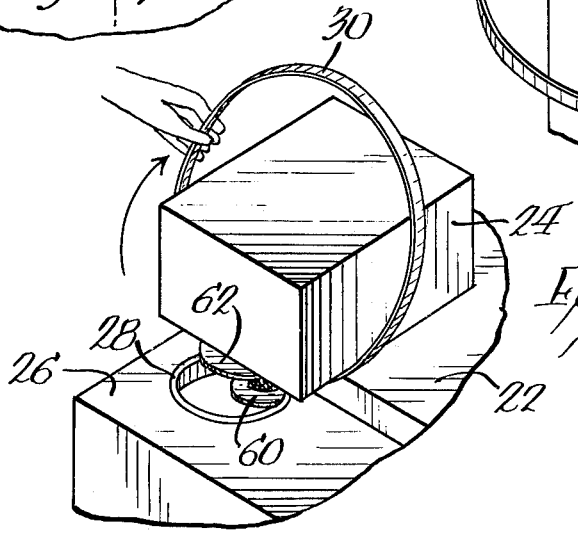
Fig. 5

METHOD OF FORMING AND TENSIONING A STRAP LOOP ABOUT A PACKAGE

BACKGROUND OF THE INVENTION

This application is related to the concurrently filed Cheung Application Ser. No. 752,011 entitled "Expanding Strap Loop Forming And Friction Fusion Machine."

In the past, Signode Corporation, the assignee of the entire interest of the present invention, has developed several processes and machines for forming a strap loop about a package, tensioning the loop, and joining the overlapping portions of the tensioned loop.

Some strapping machines, such as the machine disclosed in the Kobiella U.S. Pat. No. 3,442,203, are of the completely automatic type, i.e., one which automatically feeds a thermoplastic strap around a package from a strap supply source, grips the leading end of the strap, withdraws the standing length of the strap to tension the strap loop, friction-fuses the overlapping portions of the loop, and severs the loop from the standing length of the strap. However, this type of automatic strapping machine has a relatively large, ring-like, rigid chute into which the package is inserted and in which the strap is fed to form a closed loop around the package. With thermoplastic strap, problems have been encountered wherein the strap may buckle or jam in the chute as the strap is fed around the package. This is due to the relatively low column strength of the thermoplastic strap. In addition, a ring-like chute adds considerable bulk to the machine and requires a work space, or operating space, large enough to accommodate the chute and large enough to provide insertion and removal areas for the package.

It would be desirable to devise a strapping method wherein the strap loop could be formed without the need for a large, ring-like chute into which a package must be inserted. Use of such a method would require relatively less space than the present method that requires a chute. Thus, a method that does not require a chute could be performed on a work table or desk and could be used for strapping small packages.

Automatic strapping machines which use ring-like chutes to form the loop about the package are somewhat inefficient with respect to strapping different size packages. For example, if a strapping machine is intended to strap large packages, say 3 feet in diameter, then the strap chute must be at least 3 feet in diameter. If, subsequently, the machine is used to strap much smaller packages, say 1 foot in diameter, then the strap loop formed around the smaller package is initially three feet in diameter and the machine must withdraw a substantial amount of trailing strap during the tensioning process to decrease the diameter of the loop and tighten it about the 1-foot diameter package. This is obviously inefficient. Therefore, it would be desirable to provide a method for forming a strap loop of any desired size. Such a method would advantageously be used in strapping operations where the size of the packages would vary.

SUMMARY OF THE INVENTION

The method of the present invention utilizes a novel concept of first forming a small, or primary, strap loop and then expanding the formed primary loop to a larger predetermined size. Formation of the primary loop can be accomplished without the use of a ring-like chute into which the package to be strapped must be placed.

In the preferred embodiment of the method of the present invention, the primary strap loop is formed by feeding a length of strap into a substantially circular guide or cup so that the strap free end is guided around in a circle by the inner periphery of the cup to form a loop with the strap free end overlapping a portion of the loop. Next, the formed primary strap loop is held, gripped or guided to maintain the primary strap loop in the plane of its original formation and the circular cup is lowered away from the primary loop in a direction normal to the plane of the loop. The loop is then expanded to a size large enough to fit around the particular package to be strapped. More specifically, the strap free end is gripped or restrained from further movement while the standing length of strap is continued to be fed to expand the loop to the desired size. The package is then moved near, or over, a portion of the expanded loop and the loop is placed about the package, after which the loop is tensioned to tighten it about the package. When the loop has been sufficiently tightened, the strap free end is connected or joined to an adjacent overlapping portion of the loop by appropriate means, such as by friction fusion, application of an independent seal, or by formation of an interlocking slit type joint. The completed loop can then be severed from the trailing length of strap.

Numerous other advantages and features of the present invention will become readily apparent from the following detailed description of the invention and embodiments thereof, from the claims and from the accompanying drawings.

BRIEF DESCRIPTION OF THE DRAWINGS

In the accompanying drawings forming part of the specification, and in which like numerals are employed to designate like parts throughout the same, FIG. 1 is a partial perspective view of an embodiment of an apparatus for strapping a package according to the preferred method of the present invention;

FIG. 2 is an enlarged, partial, fragmentary top view of the strap loop forming area of the apparatus of FIG. 1;

FIG. 3 is a cross-sectional view taken generally along the plane 3—3 of FIG. 2;

FIG. 4 is a partial perspective view similar to FIG. 1 showing an expanded strap loop;

FIG. 5 is a partial perspective view similar to FIG. 4 showing the expanded strap loop being located about the package;

DESCRIPTION OF THE PREFERRED EMBODIMENTS

Figure 6:
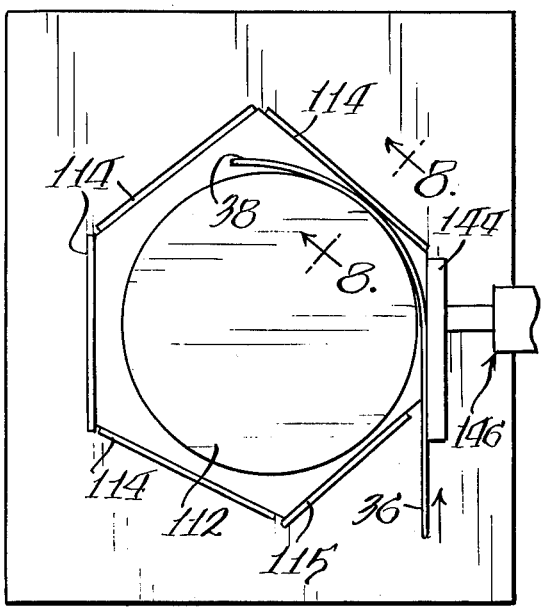
FIG. 6 is a top view similar to FIG. 2 of the strap loop forming area of a second embodiment of an apparatus for strapping a package according to the method of the present invention.

While this invention is susceptible of embodiment in many different forms, there are shown in the drawings and will herein be described in detail several preferred embodiments of the invention. It should be understood, however, that the present disclosure is to be considered as an exemplification of the principles of the invention and is not intended to limit the invention to the embodiments illustrated.

Figure 22:
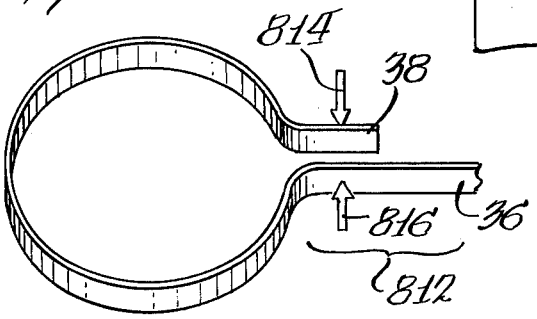
FIG. 22 is a simplified, partially schematic diagram illustrating another form of a primary strap loop according to the method of the present invention.

In the following description, two digit numerals are used to refer to the embodiment illustrated in FIGS. 1 through 5, three digit numerals in the one hundred series are used to refer to the embodiment illustrated in FIGS. 6 through 8, three digit numerals in the two hundred series are used to refer to the embodiment illustrated in FIG. 9, three digit numerals in the three hundred series are used to refer to the embodiment illustrated in FIGS. 10 and 11, three digit numerals in the four hundred series are used to refer to the embodiment illustrated in FIG. 12, three digit numerals in the five hundred series are used to refer to the embodiment illustrated in FIGS. 13 through 16, three digit numerals in the six hundred series are used to refer to the embodiment illustrated in FIGS. 17 through 19, three digit numerals in the 700 series are used to refer to the embodiment illustrated in FIGS. 20 and 21, and three digit numerals in the 800 series are used to refer to the embodiment illustrated in FIG. 22. The same last two digits in each numeral designates similar or functionally analogous elements in the various embodiments.

For ease of description, the various apparatus that may be used for strapping a package according to the method of this invention will be described in normal operating position, and terms such as upper, lower, horizontal, etc., will be used with reference to this normal operating position. It will be understood, however, that the apparatus which is used to effect the method of this invention may be manufactured, stored, transported, sold and operated in orientation other than the normal operation position described.

The apparatus illustrated herein which may be used to effect the method of this invention has certain conventional drive mechanisms and control mechanisms which, though not fully illustrated or described, will be apparent to those having skill in the art and an understanding of the necessary functions of such drive mechanisms causing proper operation of the apparatus as will be explained.

The method in accordance with the present invention is illustrated as being performed by a particular apparatus 20 in FIGS. 1 through 5. In general, as shown in FIG. 1, the apparatus 20 has a package support surface 22 for supporting a package 24 and a lower surface or shoulder 26 stepped below the elevation of the package support surface 22. Preferably, the apparatus 20 is of a size suitable for being placed on a work table or desk and is advantageously used to strap rectangular parallelpiped-shaped packages having dimensions of between 5 and 40 inches on each side. However, the method of the present invention and the apparatus 20 can accommodate much larger or smaller packages, as well as packages of different shapes.

OUTLINE OF THE MAJOR STEPS OF THE STRAPPING SEQUENCE

To aid in understanding the details of the method of the present invention, a brief outline of the method or process of forming and securing a strap loop about a package with the apparatus 20 will be presented.

As illustrated in FIG. 1, a package 24 is initially placed upon the package support surface 22 near shoulder 26. A cylindrical cup 28 is raised from a position below the surface of shoulder 26 to an elevated position above the surface of shoulder 26. By a novel means, as will be described in detail hereinafter a length of strap is fed into the cup to form a primary strap loop. The cup 28 is then lowered to a position below the surface of shoulder 26 while the loop is maintained at the higher elevation where it is then expanded to a predetermined larger diameter loop 30 as illustrated in FIG. 4. Next, the package 24 is slid forward to overhang shoulder 26 and the operator then places the expanded loop 30 about the package 24 as illustrated in FIG. 5. The strap is tensioned to draw the loop tight about the package and the entire process is completed when the tensioned loop is friction fusion welded to form a connection and the strap severed from the strap supply.

The specific features of the apparatus 20 used to accomplish the above-described package strapping process are fully set forth in the aforementioned concurrently filed Cheung Application Ser. No. 752,011 entitled "Expanding Strap Loop Forming And Friction Fusion Machine" and attention is directed thereto. The major process steps of the instant method invention are preformed by the apparatus 20 and involve (1) strap loop formation; (2) strap feeding and tensioning; (3)

strap loop joint formation; and (4) strap severance. The basic features and mechanisms of the apparatus 20, insofar as they relate to these steps, will also be fully described here to provide a basis for subsequent descriptions of alternate embodiments of apparatus for effecting these steps, as well as for the appended method claims.

STRAP LOOP FORMATION

A novel feature of the present invention is the step of automatically first forming a primary strap loop that can be subsequently expanded to any larger size. A mechanism for forming the primary strap loop is most clearly shown in FIG. 2.

By a strap feed mechanism described hereinafter, the strap is fed into a guide means. A circular band member, or cup 28, provides a circular guide means for forming the primary strap loop. Cup 28 is a substantially cylindrical member and may or may not have open ends. In the preferred embodiment illustrated, cup 28 has a partially closed bottom and an open top. A portion of the vertical cylindrical wall of the cup is cut away to form a relatively large opening or slot 34 for receiving a length of strap 36. The cup 28 guides the strap free end 38 in a closed arcuate path whereby the free end 38 is directed back upon the length of strap 36 to form the initial primary strap loop with the free end of the strap overlapping a portion of the formed strap loop.

The cup 28 is movable between an upper, or raised position and a lowered position by suitable mechanisms and controls, such as those described in the aforementioned Cheung Application Ser. No. 752,011 entitled "Expanding Strap Loop Forming And Friction Fusion Machine."

The length of strap 36 is oriented with its side surfaces perpendicular to the plane of the package support surface 22 and is guided beneath the package support surface 22 in a strap transport zone 40 which lies between the package support surface 22 and the plane of shoulder 26. The strap transport zone 40 has a thickness substantially equal to the width of the length of strap 36 and is essentially a stratum in which the length of strap 36 is fed, guided, formed into a primary loop, expanded into a larger loop, tensioned, friction welded and severed. In the raised position (as illustrated in FIG. 1), the cup 28 lies in the strap transport zone 40. In the lowered position (as illustrated in FIG. 4), the cup 28 lies below the strap transport zone 40. The length of strap 36 is guided within the strap transport zone 40 by appropriate guideways 52 as illustrated by dashed lines in FIG. 2. The strap is also fed forward and tensioned rearward through the guideways 42 in zone 40 by appropriate traction drive means as will be described hereinafter.

During loop formation, the strap feed end 38 is 1) guided into the cup slot 34, 2) maintained within the cup 28 by upper and lower guides, and 3) restrained above cup 28 during lowering of cup 28 and subsequent expansion of the loop. These guides and strap restraining means will be described with reference to FIGS. 2 and 4. Adjacent slot 34 is an anvil 44 which is mounted on movable slide 46. A portion of anvil 44 adjacent the length of strap 36 has a smooth-surfaced polyurethane pad 48 secured thereto for guiding and contacting length of strap 36 as will be described hereinafter. Opposite the polyurethane pad 48 is a cylindrical member, or weld head 52, which uniquely serves two functions: 1) gripping the strap free end 38 and 2) welding the free end to the overlapped portion of the loop. The welding function will be described later. At this point, just the gripping or restraining feature of the weld head will be discussed. The weld head 52 is mounted on shaft 53 and is a substantially cylindrical member having a rough, peripheral gripping surface adapted for contacting a side of the strap free end 38. Both the weld head 52 and the anvil 44 lie in the strap transport zone 40 as illustrated in FIG. 3.

The anvil 44 is moveable, by appropriate drive means, within the transport zone 40 in a horizontal plane towards and away from the weld head 52. An appropriate drive means is disclosed in the aforementioned Cheung Application Ser. No. 752,011 entitled "Expanding Strap Loop And Friction Fusion Machine." When the cup 28 is in the raised position as illustrated in FIGS. 1 and 2, the anvil 44 can be moved towards the weld head 52 to a position spaced away from the weld head where a portion of the anvil 44 contacts the cup 28 at abutment surface 56 and remains biased there against. In this position there is sufficient clearance between the weld head and the polyurethane pad 48 to allow the length of strap 36 and the overlapping free end 38 to lie therebetween. When the cup 38 is lowered below the surface of shoulder 26, the anvil 44, being biased towards the weld head 52, moves toward the weld head 52 to bring the polyurethane pad 48 into contact with the length of strap 36 lying therebetween to restrain the overlapping strap free end 38 from movement.

Referring now to FIGS. 2 and 3, the detailed formation of the primary strap loop will now be described. First, the free end 38 of a length of strap 36 is fed forward in the strap transport zone 40 between the strap transport guideways 42 and through aperture 34 of cup 28. The strap free end 38 is guided by polyurethane pad 48 and a portion of anvil 44 as it enters the interior of cup 28. The strap free end 38 is guided by the interior surface of cup 28 in a closed arcuate path to form an initial primary loop with the free end 38 overlapping a portion of the loop between the anvil 44 and the weld head 52. By suitable control means, the feeding of the strap length 36 is terminated.

It is desirable during the primary loop formation stage, as well as during subsequent tensioning and welding stages, to maintain the overlapped portion of the strap length 36 and the free end 38 in the elevation of the strap transport zone 40. To this end, appropriate upper and lower guides are provided. A flange 60 is provided in the lower end of the weld head 52 for keeping the overlapped portion of the strap length 36 and strap free end 38 from running below weld head 52. A slide cover 62 is secured to, and moveable with, slide 46 above the strap transport zone 40 to prevent the overlapped portion of the length of strap 36 and the strap free end 38 from riding above the weld head 52 and the polyurethane pad 48.

After the primary strap loop has been formed, the cup 28 must be lowered from its elevated position in the strap transport zone 40 to a second position below the strap transport zone 40. As the cup is lowered, the formed primary strap loop does not ride in the cup 28 to the lowered position, but rather slides out of the cup and remains at the upper position. This is due to the combination of the relatively small diameter of the cup 28, the stiffness of the strap, the low coefficient of friction between the strap and the cup, and the fact that the strap length 36 is supported on its bottom edge in the strap transport zone guides 42. Consequently, when the cup 28 is lowered, the formed primary strap loop is maintained at the elevation of the strap transport zone 40 above the top surface of the shoulder 26.

After the cup 28 is completely lowered away from the primary strap loop, any tendency of the loop to uncoil or unwind is resisted. Owing to the proximity of the weld head 52 and the polyurethane pad 48 on opposite sides of the overlapping strap portions of the loop, the loop is not above to unwind and is thus maintained in a loop.

A novel method is used to expand the formed primary strap loop to a larger loop of predetermined diameter. With the cup 28 in the lowered position as illustrated in FIG. 4, slide cover 62, anvil 44 and polyurethane pad 48 are moved closer toward weld head 52 by slide 46 under the influence of a biasing mechanism (not illustrated). Anvil 44 is moved forward to force polyurethane pad 48 against the strap loop in a region where the strap free end 38 overlaps the overlapped portion of the loop formed by the length of strap 36. The polyurethane pad 48 then contacts a side of the length of strap 36 to force both the length of strap 36 and the overlapping strap free end 38 against weld head 52. By suitable biasing controls (e.g., as disclosed in the aforementioned Cheung Application Ser. No. 752,011 entitled "Expanding Strap Loop Forming And Friction Fusion Machine"), the polyurethane pad 48 is maintained against the loop with a relatively small amount of force such that the strap free end 38 is restrained from moving by the roughened peripheral gripping surface on the weld head 52. However, the force is low enough (about 2 pounds) to permit the overlapped length of strap 36 to slide forward between the strap free end 38 and the smooth-surfaced polyurethane pad 48 when the length of strap 36 is fed to expand the loop. Preferably, during the expansion of the primary strap loop, the surface of shoulder 26 provides the support for the bottom of the strap loop as it expands.

After the loop has been expanded to the predetermined larger diameter and placed around the package 24 as shown in FIG. 5, the loop 30 is tensioned and tightened about the package 24. The details of the mechanism for applying tension to the strap will be discussed later. It is first necessary to describe the action of the polyurethane pad 48 and the weld head 52 during the tensioning process. At the beginning of the tensioning phase, the strap loop 30 is disposed about the package 24 as illustrated in FIG. 5. At this time, the cup 28 is in the lowered position below the surface of the shoulder 26. The strap loop 30 is then tensioned about the package 24 to form a tight loop.

During tensioning, a tensile force is transmitted along the length of the strap 36 which is considerably higher than the small compressive force which exists in the portion of the strap between the strap feed mechanism and the polyurethane pad 48 as the strap is being fed to form the expanded loop. Consequently, during tensioning the higher force occurring in the strap would tend to pull the strap free end 38 from its restrained engagement against weld head 52. To overcome this possibility, the polyurethane pad 48 is forced against the strap and weld head 52 during tensioning with a large force to cause strap free end 38 to remain restrained against the weld head 52. In the embodiment of the apparatus illustrated, it has been found that a force of about 30 to 40 pounds is sufficient to maintain the strap free end 38 between the polyurethane pad 48 and the weld head 52 as the overlapped length of strap 36 is tensioned. Typically, the strap loop is tensioned to about 10 to 15 pounds.

During the tensioning process, the upper edge of the strap, in the region of the strap overlap between the polyurethane pad 48 and the weld head 52, is nearer the bottom surface of the package 24 than is the bottom edge of the strap. Preferably, the strap loop 30 is maintained in the 90° twist orientation illustrated in FIG. 5 such that both the upper and lower edges of the strap in the region between the polyurethane pad 48 and the weld head 52 are located in the plane of the loop as the loop is tensioned about the package 24. Although the sliding surface of polyurethane pad 48 and the opposed peripheral gripping surface of weld head 52 are shown in FIG. 3 as being perpendicular to the slide cover 62 and to the bottom of the package 24, such orientation is not necessarily required. The surfaces on both the polyurethane pad 48 and the weld head 52 could be angled with respect to the plane of the strap loop 30 about the package 24.

During the tensioning process, slide cover 62 lies between the bottom surface of package 24 and the strap loop 30. With some types of soft packages and at certain high tension levels, the slide cover 62 serves to prevent the loop 30 from pulling out of engagement from between the polyurethane pad 48 and the weld head 52. After tensioning, when the slide cover 62 is removed from between the package 24 and the loop 30 as will be described hereinafter, a certain amount of slack is thus present in the tightened loop. However, due to the elasticity of the plastic strap and due to the compressibility of the package 24, a tight loop is nevertheless achieved when the slide cover 62 is removed. Additionally, the slide cover 62 can be made relatively thin (in the vertical direction as viewed in FIG. 3) and can be made relatively narrow with respect to the package width (as viewed in the horizontal direction in FIG. 4) to minimize the amount of slack formation. Further, with certain types of packages (such as those having rather rigid and incompressible surfaces), and with low loop tensions, the slide cover 62 can be eliminated altogether. This is because, at low tension levels, the strap loop has less of a tendency to be pulled out of engagement from between the polyurethane pad 48 and the weld head 52. Further, the relative incompressibility of the package 24 would prevent the strap loop 30 from sinking into the package and pulling away from the polyurethane pad 48 and the weld head 52.

Although the tensioning process is illustrated in FIG. 5 as occurring with the overlapped portions of the strap loop oriented in a plane parallel to the plane of the strap loop about the package, the loop 30 could be tensioned in other orientations. With very large packages and with very small weld head diameters, it would be possible to insert the package into the expanded loop when the loop is in the horizontal position as shown in FIG. 4. Then the loop could be tensioned in that horizontal configuration. Though the diameter of the weld head 52 would create some amount of slack in the tensioned loop, with large compressible packages such slack would be negligible and would not affect the integrity of the tightened loop. If the strap loop was to be tensioned about the package in the horizontal direction, then the upper surface of shoulder 26 would advantageously be located at a lower elevation with respect to the weld head 52 and the strap transport zone 40 than is shown in FIG. 6. The increased depth would accommodate placement and insertion of large packages within the horizontally oriented loop. Of course, if the loop were to be tensioned in the horizontal direction, provisions could also be made for automatically withdrawing the weld head 52 from between the strap and the package after the tensioning process has been completed.

STRAP FEEDING AND TENSIONING

The strap is both fed and tensioned by one traction wheel assembly. A traction wheel 68 and adjacent idler wheel 70 are mounted for horizontal rotation below the package support surface 22 and are illustrated in dashed lines in FIG. 2. The idler wheel 70 is preferably spring-biased against the traction wheel 68. The strap 36 is threaded in the guideways 42 and between the traction and idler wheels 68 and 70, respectively. Traction wheel 68 is shaft mounted and is rotatably drivable in either direction by an appropriate drive means. The drive means rotates the traction wheel 68 first clockwise (as viewed in FIG. 2) to feed the strap to form the loop and then counterclockwise (as viewed in FIG. 2) to tension the loop.

A bulk supply of strap is preferably wound on a conventional self-supporting spool (not shown) which can be placed near the apparatus 20 and which rotates to deliver strap in response to the feed force of the traction wheel 68 pulling on the strap.

By suitable control means, the traction wheel is rotated just enough to cause the length of strap 36 to form a primary strap loop within cup 38 with the strap free end 38 overlapping a portion of the loop (the final orientation being illustrated in FIG. 2). After formation of the primary strap loop in the cup 28, the cup 28 is lowered away from the loop and the traction wheel 68 is driven to expand the loop to a predetermined size. The cup 28 can be lowered quite rapidly so that it is not necessary to terminate the strap feeding process while the cup 28 is being lowered. Thus, the strap can be continuously fed without interruption until the desired expanded loop diameter is achieved.

After the expanded loop is placed around the package, the rotation of the traction wheel is rotated in the opposite direction to tension the loop. The tensioning process is terminated when the desired level of loop tension is sensed by a suitable tension sensing control means.

STRAP LOOP JOINT FORMATION

The method and mechanisms for connecting the strap free end 38 to the overlapped portion of the length of strap 36 will now be described. With plastic strap, or plastic-coated metal strap, a welded or friction-fused joint can be achieved by heating the overlapped region of the loop.

In the preferred embodiment, the fusion heat is generated by rapidly moving the strap free end 38 against the overlapped portion of the length of strap 36 to generate heat by friction and effect interface melting therebetween. More particularly, this is accomplished by oscillating the weld head 52 with a relatively small angular rotation at a sufficiently high frequency. Weld head 52 is rotatably oscillated about the shaft 53 so that its peripheral gripping surface, being engaged with a side of the strap free end 38, causes the strap free end 38 to be moved back and forth with respect to the stationary overlapped portion of the length of strap 36. Typically, the frequency of oscillation is between about 50 and 100 hertz, the total amplitude of circumferential rotation of the weld head gripping surface is about 0.15 inch, and the oscillation period lasts from between 0.75 to 1.0 seconds. In order to insure an adequate weld, the polyurethane pad 48 is pressed against the overlapped portion of the length of strap 36 with a higher force than is used during the tensioning process. Typically, a force of about 100 pounds is impressed against the strap during the friction-fusion process.

The weld head 52 is driven in the oscillatory mode by appropriate drive means and oscillating drive transmission (not shown) which are well known and commercially used in present friction fusion strapping machines. A description of such mechanisms can be found in the U.S. Pat. No. to Ericsson, 3,586,572.

After the friction-fusion joint has been completed, the cup 28 is still maintained in the lowered position below the surface of shoulder 26 while the weld head 52 and the polyurethane pad 48 are maintained in compressive engagement on the strap loop so that the strap loop can be severed from a standing portion of the strap length 36 as will be described in detail in the next section.

With metal strap, other types of joints could be created through the use of additional, conventional joint forming mechanisms (not illustrated). Such other joints may be, for example, of the independant seal type or of the interlocking slit type. Descriptions of such seals and sealing mechanisms can be found in the U.S. Pat. No. to Crosby, 2,710,435; to Crosby et al., U.S. Pat. No. 2,801,558; and to Beach, U.S. Pat. No. 3,303,541.

STRAP SEVERANCE

After the loop has been connected by the friction-fused weld, the standing portion of the strap is severed from the loop by cutter blade 71 as best illustrated in FIG. 2. The cutter blade 71 is fixed in a slide block 72 which is slidably mounted for movement toward and away from strap 36. The cutter blade 71 is moved by a suitable linkage and drive means such as described in the aforementioned Cheung Application Serial No. 752,011 entitled "Expanding Strap Loop Forming And Friction Fusion Machine."

After the strap has been severed, the anvil slide 46 is moved away from the weld head 52 to retract the anvil 44 and the slide cover 62. With the anvil 44 retracted, the fused portion of the strap loop adjacent the weld head 52 is relieved from its 90° twist configuration with respect to the balance of the loop and lies flat along the bottom surface of the package. Since the slide cover 62 is also retracted, the tensioned strap loop tightens further, under influence of its elasticity, to fit tight around a portion of the surface of the package that was previously in contact with the slide cover 62. The strapped package can then be removed from the apparatus.

ALTERNATE EMBODIMENTS

Formation of the strap loop with the apparatus illustrated in FIGS. 1 through 5 and heretofore described involves the use of a movable, circular guide (cup 28). The strap loop formation step of the method of the present invention can also be performed in a number of other ways.

In each of the embodiments, certain mechanisms, though not always illustrated, will be understood to exist and function analogously to those mechanisms heretofore described for the embodiment illustrated in FIGS. 1–5. Examples of such mechanisms are the strap transport zone guides 42, the traction wheel 68, the idler wheel 70, and the cutter blade 71, as well as the necessary drive means, controls, and support structures. In all of the alternate embodiements an anvil and associated slide mechanism are provided (as schematically illustrated and designated 144 and 146, 244 and 246, 344 and 346, 444 and 446, 544 and 546, and 644 and 646 in FIGS. 6–8, 9, 10 and 11, 12, 13–16, and 17–19, respectively). The anvil and slide in these alternate embodiments are understood to perform the same functions as the anvil 44 and slide 46 of the embodiment illustrated in FIGS. 1 through 5 and as heretofore described.

Figure 7:
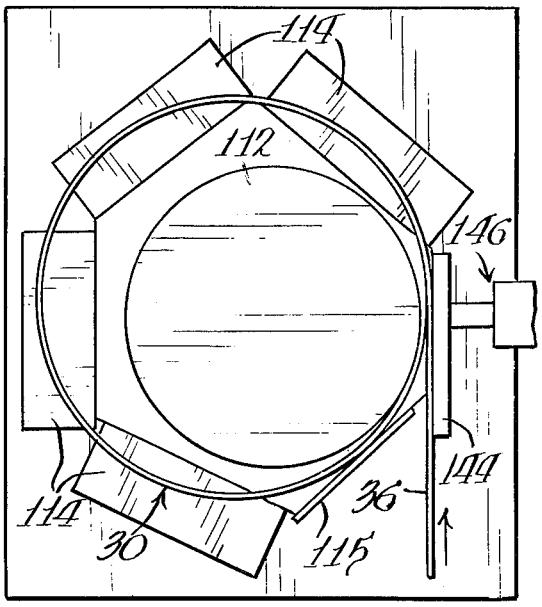
FIG. 7 is a view similar to FIG. 6 showing the method of expanding the strap loop to a larger diameter.
Figure 8:
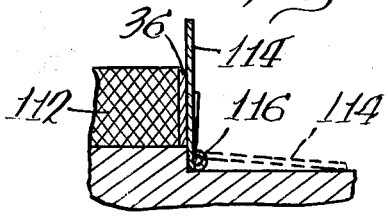
FIG. 8 is a cross-sectional view taken generally along the plane 8—8 of FIG. 6.

FIGS. 6 through 8 schematically illustrate another way of performing the step of forming a primary strap loop and expanding the strap loop to a larger diameter by use of an alternate, or second embodiment of a strap loop forming mechanism. The mechanism illustrated would be used in a strapping apparatus, such as the strapping apparatus 20 illustrated in FIGS. 1 through 5, and would be located in the strap loop forming area of the apparatus (the strap loop forming area of apparatus 20 is illustrated in FIG. 2). Specifically, in place of the weld head 52, a loop forming wheel 112 is provided and functions as an inner guide for the length of strap 36 as the strap free end 38 is fed tangentially with the perimeter of the wheel.

Surrounding the wheel 112, and spaced from it, are a number of pivotable guide plates 114 which are spring-biased to a vertical position and provide a strap guide on the loop exterior side of the length of strap 36. FIG. 8 shows one of the pivotable guide plates 114 biased to the vertical direction by an appropriate spring mechanism 116 and further shows a portion of the strap 36 adjacent one side of the plate 114 as the strap is guided thereagainst. The guide plates can be of varying size and number. In the embodiment illustrated, there are four guide plates forming a roughly polygonal shape, or more specifically, 4/6 of a hexagon. A fifth side of the hexagon is formed by a stationary guide plate 115 and a sixth side of the hexagon is formed by a smooth-surfaced pad or anvil 144 which is movable towards and away from the wheel 112 by an appropriate slide mechanism 146.

During the stage of initial loop formation, the strap free end 38 is fed into the strap loop forming area between the wheel 112 and the anvil 144 and is guided by the wheel 112 and the guide plates 114 and 115 to form a loop therebetween. After the strap has been fed in a circle slightly greater than $2\pi$ radians to form the loop with a portion overlapped by the strap free end 38, the anvil 144 is moved closer towards the wheel 112 to apply a predetermined amount of force against the overlapped portions of the strap loop between the anvil and the wheel so that the overlapped portions are lightly held together. The wheel 112 preferably has a rough peripheral surface for contacting a side of the strap free end 38. The strap is continued to be fed against the guide plates 114 and the strap free end 38 is restrained, against the wheel 112, from further movement. With an appropriate choice of the strength of the spring 116 used to bias the guide plates 114 to the vertical position, the plates 114 will be forced to pivot outwardly and down by the force of the expanding strap loop to assume the position shown in dashed lines in FIG. 8. This will permit the strap loop to expand to a larger size 30 as illustrated in FIG. 7.

When the loop has been expanded to the proper predetermined size, the strap feeding process is terminated. Next, a package can be located over a portion of the loop and the loop can be twisted 90° (out of the plane of FIGS. 6 and 7) to place it around the package for subsequent tensioning in the manner previously described for the embodiment illustrated in FIG. 5. The wheel 112 may be relatively small, say between 1 and 2 inches in diameter, or may be much larger. Regardless, if plastic strap or plastic-coated metal strap is used, the wheel 112 can be oscillated with a small angular rotation at a sufficiently high frequency to form a friction-fused joint in the manner analogous to that described for the embodiment of the weld head 52 previously described and illustrated in FIGS. 1 through 5.

Severance of the strap loop from the trailing length of strap can be effected by a suitable strap severing mechanism, not illustrated, such as the cutter blade 71 previously described in the embodiment illustrated in FIG. 2.

Figure 9:
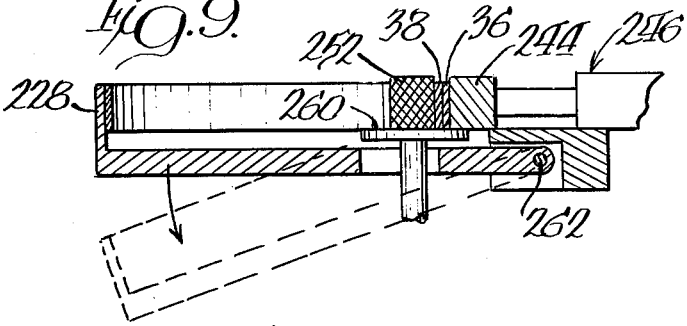
FIG. 9 is a view similar to FIG. 3 illustrating the strap loop forming area of a third embodiment of an apparatus for strapping a package according to the method of the present invention.

A third embodiment of the strap loop forming mechanism of an apparatus for strapping a package according to the method of the present invention is illustrated in FIG. 9 and is similar to the strap loop forming mechanism of the first embodiment illustrated in FIGS. 1 through 5. A cup 228 is provided to receive the length of strap 36 and to guide the strap free end 38 on the inner periphery thereof to form a primary strap loop. A weld head 252 is provided inside the cup 228 and has a lower guide flange 260 to maintain the plane of strap 36 at the proper elevation within the cup 228. An anvil 244 and movable slide mechanism 246 are illustrated schematically and function in a manner analogous to the anvil 44 and movable slide mechanism 46 of the first embodiment illustrated in FIGS. 1 through 5. However, in the case of the embodiment illustrated in FIG. 9, the cup 228 is hinged, or pivotally mounted, on pin 262 for movement to a tilted position (shown in dashed lines in FIG. 9) after the primary strap loop has been formed. This provides clearance around the periphery of the primary strap loop to allow subsequent expansion thereof. The cup 228 is moved to the tilted position by any suitable drive means or actuator means (not illustrated). With the strap having an appropriate combination of thickness, width, and flexibility, any movement or tilting of the cup is not even necessarily required. That is, the cup, with a properly shaped wall, could remain stationary after formation of the primary strap loop. Then, continued feeding of the strap into the cup will cause the strap to buckle out of the cup so that it can expand to a larger size.

Figure 10:
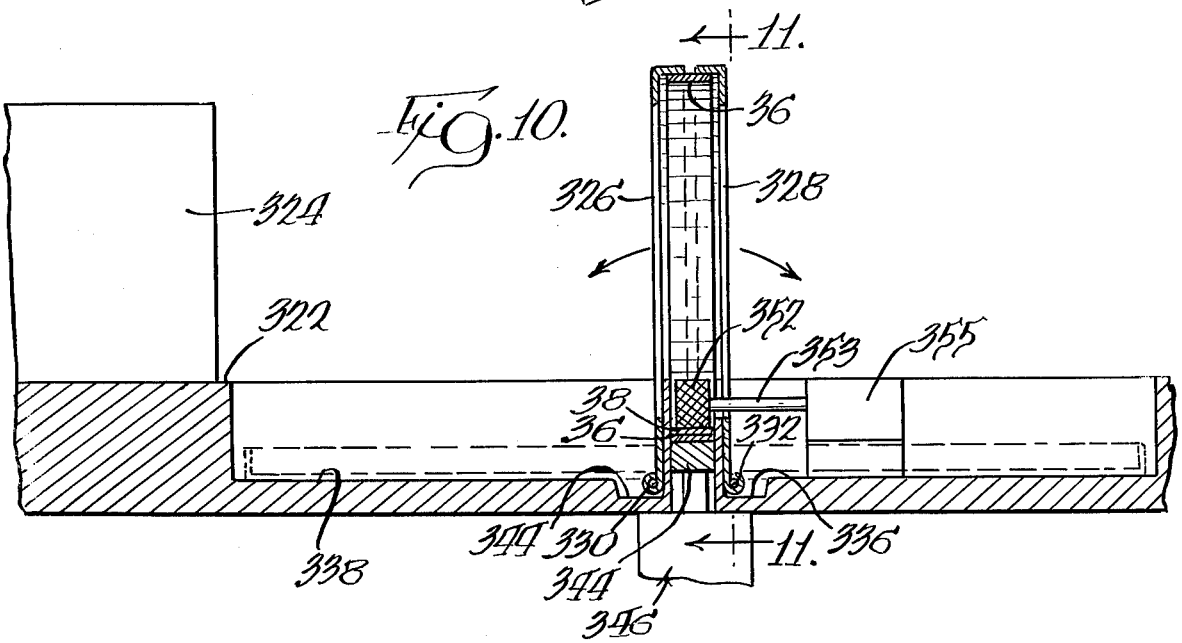
FIG. 10 is a cross-sectional view of the strap loop forming area of a fourth embodiment of an apparatus for strapping a package according to the method of the present invention.
Figure 11:
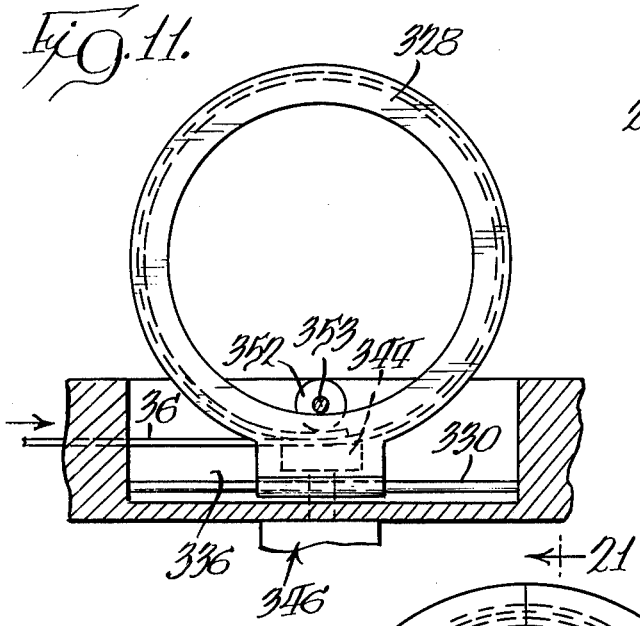
FIG. 11 is a reduced cross-sectional view taken generally along the plane 11—11 of FIG. 10.

FIGS. 10 and 11 illustrate a fourth embodiment of the strap loop forming mechanism of an apparatus for strapping a package according to the method of the present invention. In this embodiment, a strap loop is formed in a plane perpendicular to a package support surface 322 on a strapping apparatus. Initially, the package 324 is placed upon the package support surface 322 adjacent the loop forming area. A length of strap 36 is then fed between, and guided by, two axially aligned adjacent guide rings 326 and 328. The guide rings 326 and 328 are pivotally mounted on pins 330 and 332 respectively, which are mounted in recessed channels 334 and 336, respectively. The guide rings 326 and 328 can thus be rotated 90° to a position below, and parallel to, the package support surface 322. To this end, guide ring cavities 338 and 340 are provided to receive the guide rings 326 and 328, respectively. The strap 36 can be fed into a slot (not shown) between the guide rings 326 and 328 by an appropriate traction wheel mechanism.

In a manner analogous to that described for the embodiment illustrated in FIGS. 1 through 5, plastic strap or plastic coated metal strap can be formed into a primary strap loop and then gripped between a weld head 352 and an anvil 344 for the subsequent loop expansion, loop tensioning, and friction fusion steps. In FIG. 10, the anvil 344 is schematically illustrated as being movable towards and away from the strap 36 and weld head 352 by slide mechanism 346 and the weld head 352 is shown mounted on shaft 353 and driven by an appropriate drive means or motor 355.

By appropriate control means, the length of strap 36 is fed between the guide rings 326 and 328 until a primary strap loop is formed with the strap free end 38 overlapping a portion of the loop. At this point, the anvil 344 is urged against the overlapping strap portions and the guide rings are moved, by a suitable means, to the horizontal position below the package support surface 322 to provide clearance around the periphery of the loop. The loop is then expanded by continued feeding of the length of strap until the desired larger diameter is reached. The package is then moved into the loop and the loop is subsequently tightened, tensioned, and severed in a manner similar to that described for the embodiment illustrated in FIGS. 1 through 5. However, with the apparatus illustrated in FIGS. 10 and 11, the loop does not have to be twisted 90° to be placed around the package since the loop is formed initially in the plane perpendicular to the package support surface 322 and since the package 324 can be placed therein without requiring the loop to be twisted in any manner.

When the loop is tensioned about the package 324, the small weld head 352 is necessarily located between the package and the strap loop which causes the loop to be slightly larger than the periphery of the package. After the loop has been tensioned, friction-fused (or the overlapped ends otherwise suitably joined), and severed from the trailing length of strap, the weld head 352 must be removed from between the package and the strap loop. This can be accomplished by moving the combined assembly of weld head 352, shaft 353 and motor 355 away from the package (in a direction to the right as viewed in FIG. 10) by appropriate mechanisms (which are not illustrated). With very large packages and with very small weld head diameters, the creation of a slightly larger diameter loop about the package resulting from the weld head being disposed between the loop and the package is negligible. Further, if the large package was slightly resilient, the package would expand slightly to a larger diameter (and the strap itself would contract to a slightly smaller diameter) to effect a tight loop about the package.

Figure 12:
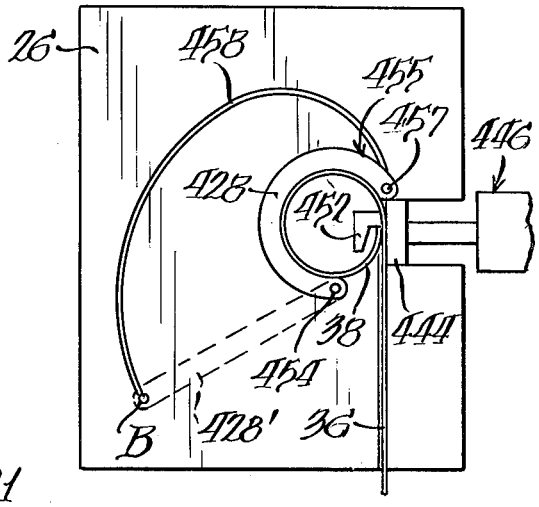
FIG. 12 is a top view of the strap loop forming area of a fifth embodiment of an apparatus for strapping a package according to the method of the present invention.

FIG. 12 illustrates a fifth way of performing the step of forming a primary strap loop and expanding the strap loop to a larger diameter. The mechanism illustrated in FIG. 12 would be used in a strapping apparatus, such as the strapping apparatus 20 illustrated in FIGS. 1 through 5, and would be located in the strap loop forming area of the apparatus (the strap loop forming area of apparatus 20 is illustrated in FIG. 2). Specifically, in place of the guide cup 28 and the weld head 52 in apparatus 20, there is provided a flexible guide band 428 and a strap free end stop block 452, respectively. Opposite the stop block 452 is an anvil 444 which is movable toward and away from the stop block 452 by a slide mechanism 446. The length of strap 36 is introduced to the inner periphery of the flexible guide band 428 between the anvil 444 and stop block 452. The strap free end 38 is guided in a circle by the inner periphery of the flexible guide band 428 and, after traveling in a circle for slightly greater than $2\pi$ radians, impinges upon the stop block 452 thus forming a primary strap loop with a portion of the loop overlapped by the strap free end 38.

The flexible guide band 428 can be of any suitably flexible material such as polyethylene or rubber, or even thin metal. In the loop forming position, the band 428 extends from an anchor point 454 in a circular locus with a free end 455 in abutment with the anvil 444. On the free end 455 of the flexible guide band is a guide pin or prong 457 which projects from the bottom of the flexible guide band 428 and into an arcuate slot or track 458 in the shoulder surface 26 of the apparatus. As illustrated in FIG. 12, the shape of the track 458 is an involute of the circle formed by the flexible guide band 428 when the band is in the position illustrated in FIG. 12 for forming the primary strap loop. After the primary strap loop has been formed, the free end 455 of the band 428 is moved in the locus of the track 458. To this end, by appropriate drive means not illustrated, the pin 457 on the free end 455 of the band 428 is driven in the track 458 to point B so that the flexible guide band 428 assumes a substantially straight line orientation illustrated by dashed lines and labeled 428'. In the straight line orientation, the flexible guide band 428' is thus spaced away from the formed primary strap loop to provide clearance about the periphery of the loop. Next, the anvil 444 is moved closer towards the loop to apply a relatively small force against the overlapped portions of the strap loop to restrain the strap free end 38 from disengaging from the stop block 452. Subsequently, by appropriate feed drive means, the length of strap 36 can continue to be fed to expand the loop to the desired larger diameter. A package can then be placed over a portion of the loop and the loop can be twisted about the package. The loop can then be tensioned and tightened about the package in a manner similar to that previously described for the embodiment illustrated in FIGS. 1 through 5. The overlapping portions of the strap loop can be joined by appropriate means, such as by a friction-fusion, application of an independent seal, or formation of an interlocking slit joint. Creation of a friction-fusion joint would require the stop block 452 to be oscillated or vibrated sufficiently rapidly to generate heat by friction and effect interface melting therebetween. Mechanisms for applying an independent seal or for forming an interlocking slit joint to metal strap would be of a conventional nature and associated with anvil 444 and stop block 452 as may be necessary or desired.

FIGS. 13 through 16 illustrate another way of performing the step for forming a primary strap loop and expanding the strap loop to a larger diameter by use of a sixth embodiment of a strap loop forming mechanism. The mechanism illustrated would be used in a strapping apparatus, such as the strapping apparatus 20 illustrated in FIGS. 1 through 5 and previously described. The strap loop forming mechanism would be located in the strap loop forming area of the apparatus (the strap loop forming area of apparatus 20 is illustrated in FIG. 2).

Figure 15:
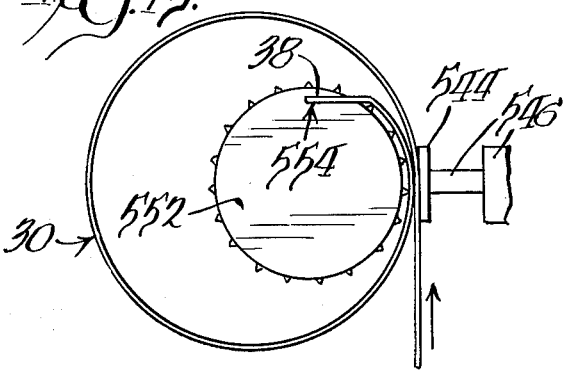
FIG. 15 is a view of the sixth embodiment, similar to FIG. 14, illustrating the formation of an expanded strap loop.

In this sixth embodiment, a strap guide is not required. Instead, a wheel 552 is provided (in place of the weld head 52 of the first embodiment illustrated in FIG. 2) which has a slot 554 for receiving the strap free end 38 of a length of strap 36. As the strap is fed by appropriate traction wheel feed means (not illustrated), the strap free end 38 enters the slot 554, abuts the end of the slot in the wheel 552 and the wheel is rotated (counterclockwise as viewed in FIGS. 13 to 15). The length of strap 36 is fed until the wheel 552 has rotated slightly greater than $2\pi$ radians so that a primary strap loop is formed with a portion of the loop overlapped by the free end 38. After the primary strap loop has been formed, the wheel 552 can be locked against further rotation while the strap length 36 is continued to be fed. An anvil 544 is provided adjacent the wheel 552 and is movable toward and away from the wheel by a slide mechanism 546 (schematically illustrated in FIGS. 13 through 16). The anvil 544 is brought into contact with the exterior side of the length of strap 36 in the area of the overlapped portion of the loop to restrain the strap against movement away from wheel 552 at that point. With the wheel 552 prevented from rotating, the primary strap loop expands from around the periphery of the wheel 552 to form a loop 30 of any desired larger size as illustrated in FIG. 15.

Figure 16:
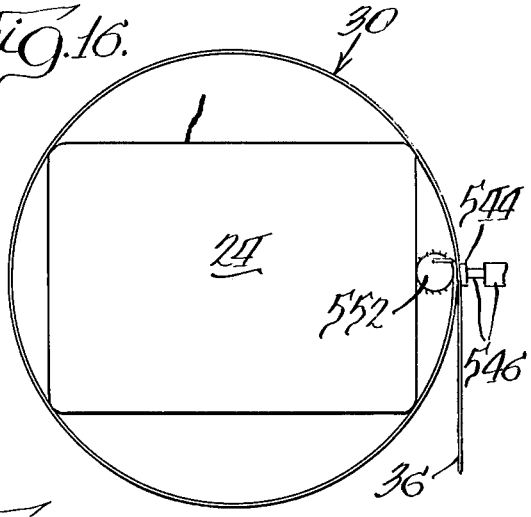
FIG. 16 is a view of the sixth embodiment, similar to FIG. 15 but much reduced in scale, to show an expanded strap loop placed about a package.

With a relatively small wheel 552 and a relatively large package 24, the package 24 can be inserted into the expanded loop as shown in FIG. 16. By means previously described for the other embodiments, the loop can then be tensioned about the package. Subsequently, the wheel 552 could also function analogously to the weld head 52, described for the embodiment illustrated in FIGS. 1 through 5, by producing a friction-fused joint. Following formation by the friction-fused joint, the wheel 552 is withdrawn from between the package and the loop.

Alternatively, instead of inserting the package 24 into the expanded loop as illustrated in FIG. 16, the expanded loop could be first twisted 90° (out of the plane of FIG. 16) and the package could then be inserted into the loop above the wheel 552 and anvil 544. Such a 90° twist orientation of the loop is identical to that effected in the process step performed by the previously described embodiment illustrated in FIG. 5.

Further, with metal strap, the overlapping portions of the strap loop could be joined by conventional independent seals or interlocking slit joints. The mechanisms for effecting such conventional joints are not illustrated in FIG. 16 but could be located adjacent the wheel 552 and anvil 544 around the overlapped portion of the strap loop.

Figure 17:
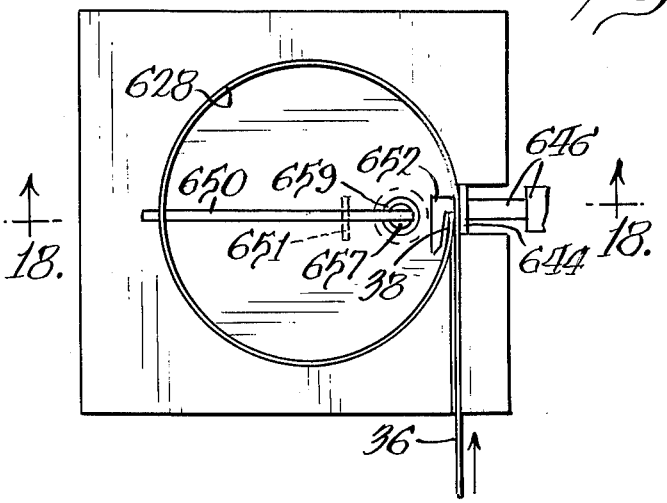
FIG. 17 is a top view of the strap loop forming area of a seventh embodiment of an apparatus for strapping a package according to the method of the present invention.
Figure 19:
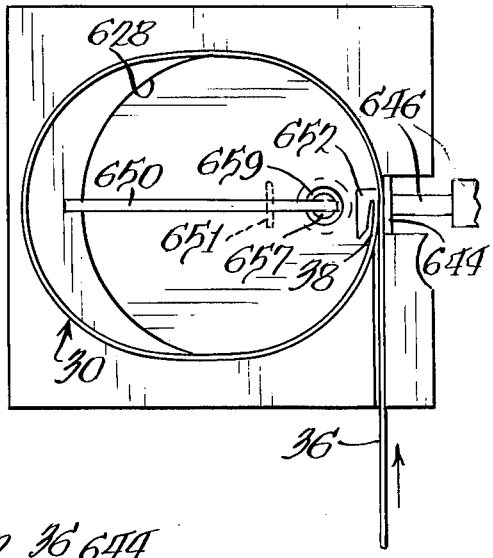
FIG. 19 is a top view of the seventh embodiment, similar to FIG. 17, showing an expanded strap loop.
Figure 18:
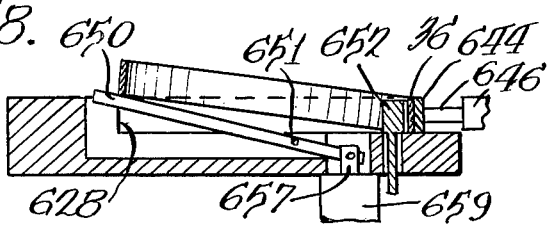
FIG. 18 is a cross-sectional view taken generally along the plane 18—18 of FIG. 17 showing a primary strap loop being lifted from a guide.

A seventh embodiment of a strap loop forming mechanism is illustrated in FIGS. 17 through 19. The mechanism illustrated therein would be used in a strapping apparatus, such as the strapping apparatus 20 illustrated in FIGS. 1 through 5, and would be located in the strap loop forming area of the apparatus (the strap loop forming area of apparatus 20 is illustrated in FIG. 2).

A substantially circular guide 628 is provided in the surface of the apparatus for receiving the length of strap 36. In place of a weld head (such as weld head 52 illustrated in FIGS. 1 through 5) a stop block 652 is provided near the periphery of the circular guide 628. Opposite the stop block 652 is an anvil 644 which is movable toward and away from the stop block by a slide mechanism 646 which is schematically illustrated in the FIGS. 17 and 18.

Initially, when the length of strap 36 is fed into the guide 628, the strap free end 38 passes between the stop block 652 and the anvil 644 which has been spaced away from the stop block 652 to allow passage therebetween. The strap free end 38 is then guided around the periphery of the guide 628 until it has completed a circular motion of slightly greater than $2\pi$ radians so that a strap loop is formed with a portion of the loop being overlapped by strap free end 38 and so that the strap free end 38 has impinged upon stop block 652.

Next, the anvil 644 is moved to press against the overlapped portion of the loop with a relatively small force and the formed primary strap loop is partially lifted out of the guide 628 to allow expansion of the loop. To this end, a lift lever 650 is provided below the formed primary strap loop and the bottom of the guide 628. Lift lever 650 is pivotally mounted on pin 651 below guide 628 and is pivotally connected on one end to rod 657 which is secured to actuator 659. Actuator 659 moves rod 657 in a vertical reciprocal motion as viewed in FIG. 18 to lower and raise, respectively, the lift finger 650.

When the lift finger 650 has been raised to the position shown in FIG. 18, the length of strap 36 can continue to be fed so that the loop 30 expands to any desired larger diameter as illustrated in FIG. 19. A package to be strapped is then placed over the stop guide block 652 and anvil 644 and the expanded loop is twisted upwardly and around the package in a manner analogous to that for the embodiment illustrated in FIG. 5. Subsequently, the loop can be tensioned by a suitable traction wheel mechanism, such as that described for the apparatus 20 illustrated in FIGS. 1 through 5.

After tensioning, a conventional independent seal or slit joint can be applied to the overlapped portion of the strap loop by mechanisms not illustrated. Alternately, the stop block 652 could be rapidly oscillated or vibrated to effect a friction fusion joint on a plastic or plastic-coated metal strap. Instead of a stop block 652, a weld head similar to the weld head 52 illustrated in FIG. 2, could be provided. It is not necessary that the strap free end 38 abut a stop block or similar member upon completion of forming the primary strap loop. This is because the strap feeding can be governed by suitable automatic rotation indexing controls to terminate the feeding of the length of strap 36 after the primary strap loop has been created with the desired amount of overlap.

Figure 20:
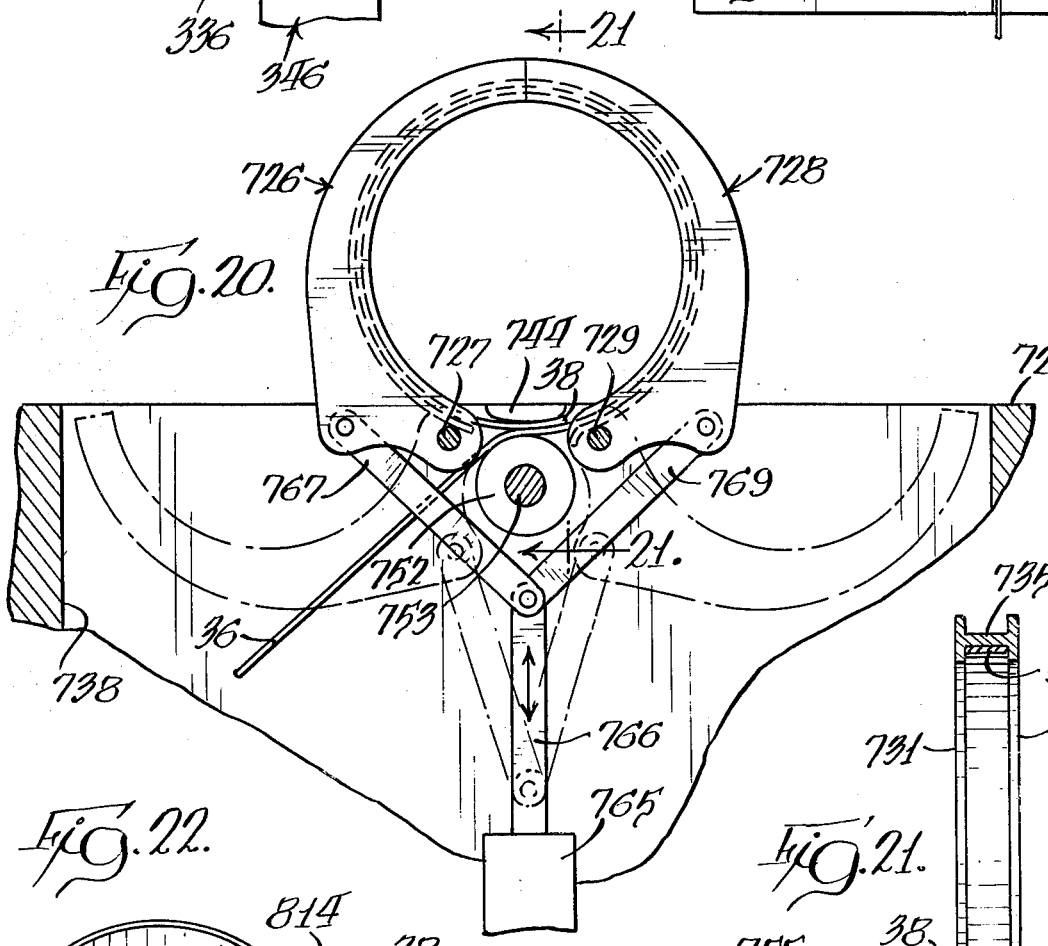
FIG. 20 is a cross-sectional view of the strap loop forming area of an eighth embodiment of an apparatus for strapping a package according to the method of the present invention.
Figure 21:
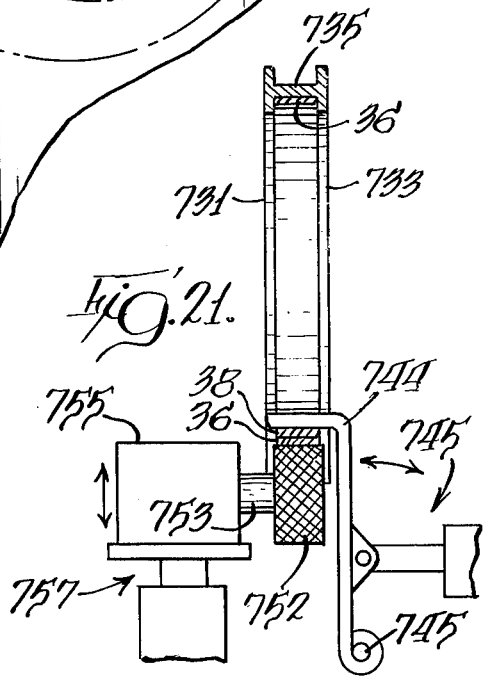
FIG. 21 is a cross-sectional view taken generally along the plane 21—21 of FIG. 20.
Figure 13:
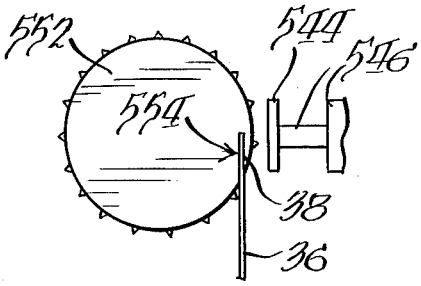
FIG. 13 is a simplified diagrammatic top view of the strap loop forming area of a sixth embodiment of an apparatus for strapping a package according to the method of the present invention.
Figure 14:
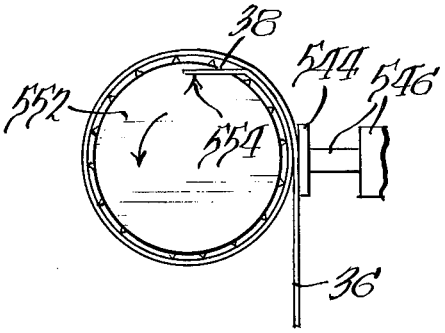
FIG. 14 is a view of the sixth embodiment, similar to FIG. 13, illustrating the formation of a primary strap loop.

An eighth embodiment of a strap loop forming mechanism is illustrated in FIGS. 20 and 21. The mechanism illustrated therein would be used in a strapping apparatus, such as the strapping apparatus 20 illustrated in FIGS. 1 through 5, and would be located in the strap loop forming area of the apparatus (the strap loop forming area of apparatus 20 is illustrated in FIG. 2). This eighth embodiment is somewhat similar to the fourth embodiment illustrated in FIGS. 10 and 11 and described above. In this eighth embodiment, strap guide rings 726 and 728 are pivotally mounted for movement into a cavity 738 below the package support surface 722. However, the guide rings 726 and 728 pivot about axes 727 and 729 respectively, which are perpendicular to the plane of the primary loop formation whereas the guide rings 326 and 328 of the fourth embodiment pivot about axes that are parallel to the plane of primary strap loop formation. The guide rings 726 and 728 each have identical cross-sections that are substantially H-shaped. As illustrated for guide ring 728 in FIG. 21, the H-shaped cross-section provides an interior channel comprising side walls 731 and 733 and a perpendicular arcuate guide wall 735, all of which function to contain and guide the strap as the primary loop is being formed.

Unlike the fourth embodiment, the eighth embodiment does not have a weld head mounted within the central portion of the guide rings. Rather, an anvil 744 is pivotally mounted about shaft 745 and has 1) a top surface flush with the package support surface 722 and 2) a strap bearing surface opposite, and facing, a combination feed/tension/weld head wheel 752. After completion of the strapping process, the anvil 744 can be pivoted out from between the package and the strap loop by an appropriate actuator and linkage mechanism 747.

The strap 36 is threaded between the anvil 744 and feed/tension/weld head wheel 752 and is fed by rotation of the wheel 752 in a clockwise direction (as viewed in FIG. 20) around the inner periphery of the vertically oriented guide rings 726 and 728 until the strap free end 38 overlaps a portion of the loop. In order for the loop to be expanded, the guide rings 726 and 728 must be pivoted about axes 727 and 729 respectively, to the lower position illustrated by dashed lines in FIG. 20. This, of course, provides an unobstructed expansion area around the perimeter of the primary loop to allow expansion thereof to a predetermined larger diameter. The pivotal movement of the guide rings 726 and 728 is effected by an appropriate actuator mechanism such as an electric solenoid or air-operated cylinder actuator 765 connected to linkage members 766, 767, and 769.

As illustrated in FIG. 21, wheel 752 is mounted on shaft 753 to motor 755. Motor 755 is mounted on carriage 757 which can move the motor, shaft, and wheel in a vertical direction by suitable drive means (not shown). The weld head 752 is generally cylindrical and presents a peripheral strap gripping surface. As the primary loop is being formed, and during subsequent operations, the weld head 752 is aligned with the strap 36 as illustrated in FIG. 21. By appropriate movement of the carriage 757, the weld head 752 can be impressed upon strap 36 so that the strap free end 38 is maintained in frictional engagement with anvil 744 while strap length 36 can continue to be fed forward into the guide rings 726 and 728, sliding against the adjacent strap free end 38, to expand the loop.

After the loop has been expanded, the rotation of wheel 752 is reversed to tension the loop about a package that has been inserted therein. If necessary, by appropriate upward movement of the carriage 757, a higher force can be applied to the overlapping strap lengths 36 and 38 by the wheel 752 during the tensioning process to hold the strap free end 38 in place.

After the tensioning is complete, a connection can be formed between the strap free end 38 and the overlapped strap length 36, such as by friction fusion wherein the wheel 752 is rapidly oscillated or vibrated to form a friction fusion joint on plastic or plastic-coated metal strap. Alternatively, a friction fusion joint could be formed by rapidly vibrating the anvil 744. In either case, the frequency and amplitude parameters relating to the formation of such a joint would be the same as has been described above under the section entitled "Strap Loop Joint Formation".

It is possible to form a loop that has an overlapping joint area different than those discussed so far. FIG. 22 schematically illustrates such a formed primary strap loop. A length of strap 36 is fed in a closed path to form a primary strap loop with a portion of the strap loop overlapped by the strap free end 38. Note that in this loop, the surface of the strap which is on the "inside" of the loop is maintained in an orientation such that, in the region of the overlap 812, the "inside" surfaces of the strap are in a facing relationship. The loop can be thus formed by hand or mechanically (which can include feeding the strap 36 in a closed path to form this type of loop). Following formation of the primary strap loop, the strap free end 38 is restrained from movement while the standing length of strap is fed to expand the loop to a predetermiend size. Then a package can be inserted into the expanded loop, after which the loop is tensioned about the package. The strap free end 38 is then joined, by appropriate means, to the overlapped portion of the strap length 36 to form a connection and secure the loop about the package.

During expansion of the loop, the strap free end 38 may be restrained from movement by pressing it, with a first member 814, against the overlapped portion to the strap 36 in the region of overlap 812. A second member 816, opposite the first member and presenting relatively less sliding resistance to strap movement, is pressed against the strap 36. Specifically, members 814 and 816 could, for example, comprise respectively, a weld head and an anvil, similar to weld head 52 and anvil 44 described for the embodiment previously described and illustrated in FIGS. 1 through 5. It should be noted that once a loop such as illustrated in FIG. 22 has been expanded, the overlapping portions can be joined by any appropriate means, including friction fusion, formation of interlocking slits, or application of an independent seal. Most importantly, the joint can be formed, as by members 814 and 816 (or other members located adjacent thereto,) without requiring that any member, or portion thereof, be placed inside the loop between the strap and the package. This has the advantage of increasing residual tension in the loop since the loop, when tensioned, can be drawn tighter around the package. Further, it should be noted that the strap loop does not necessarily have to be "twisted" to be placed about the package. The loop can be formed and expanded in one plane and the package then moved perpendicular to that plane and into the loop.

The method of the present invention can be advantageously used with compressible articles, bundles or bales. In one case, preformed metal or plastic strap segments, (e.g., bale ties) could be stacked and loaded in a magazine of an appropriate apparatus for sequential feeding (one at a time) to 1) form an initial primary strap loop and 2) subsequently form an expanded loop. This could be accomplished, in part, with apparatus similar to those described above for the various illustrated embodiments. After the loop has been expanded to a larger predetermined size, the overlapping ends of the loop could be joined by any appropriate means. Next, a compressed bale could be inserted into the strap loop and allowed to expand against the strap, thus forming a tied bale. Alternatively, the formed and joined strap loop could be removed from the strap loop forming apparatus and placed around a compressed bale which is then allowed to expand to form a tied bundle.

Instead of using separate preformed strap segments, a compressed bale could be tied with a loop formed from a continuous length of strap. Apparatus similar to that illustrated in FIGS. 1 through 5 could be used to form an expanded loop. But, instead of tensioning the loop about the bale, just the joint could be formed in the loop. Then the compressed bale could be placed in the loop and allowed to expand to form the tied bale. Alternatively, the formed and joined loop could be removed from the apparatus and then placed around the bale.

With respect to binding a compressed bale as described above, it is important to note that tension need not necessarily be drawn on the expanded strap loop. With certain types of bales, it can be sufficient to allow the compressed bale to expand into binding engagement with a formed and joined strap loop.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

We claim:

1. A method of forming a strap loop and securing it about a package comprising:

feeding a length of strap in a closed path to form a primary strap loop with a portion of the strap loop overlapped by the free end of the strap; restraining said free end of the strap from further movement while continuing to feed the standing length of the strap to expand the loop to a predetermined size; effecting relative movement between said package and the expanded loop to locate the expanded loop about said package; tensioning said length of strap to tighten the loop about said package and joining said free end of the strap and an adjacent overlapped portion of the loop.

2. The method of claim 1 wherein the step of forming a primary strap loop includes guiding a portion of one edge of the length of strap in a plane parallel to the plane of the formed primary strap loop.

3. The method of claim 1 wherein the step of forming a primary strap loop includes guiding a portion of each of the two edges of the length of strap in separate planes parallel to the plane of the formed primary strap loop.

4. The method of claim 1 wherein the step of forming a primary strap loop includes providing a generally circular guide on the exterior periphery of said primary strap loop to guide said free end of the strap.

5. The method of claim 4 including the additional step of effecting relative movement between said generally circular guide and said primary strap loop to provide clearance around the periphery of said primary strap loop to permit expansion of the loop to said predetermined size.

6. The method of claim 5 wherein the step of effecting relative movement between said generally circular guide and said primary strap loop includes maintaining said circular guide in a fixed position while raising a portion of the loop out of said circular guide to permit expansion of the loop to said predetermined size.

7. The method of claim 5 wherein the step of effecting relative movement between said generally circular guide and said primary strap loop includes maintaining said loop in a fixed plane while moving said circular guide normal to, and away from, said loop.

8. The method of claim 5 wherein the step of effecting relative movement between said generally circular guide and said primary strap loop includes maintaining said loop in a fixed plane while pivoting said circular guide away from said loop.

9. The method of claim 1 wherein the step of forming a primary strap loop includes feeding a length of strap against walls of a guide structure wherein each wall forms a side of a polygon.

10. The method of claim 9 including the additional step of pivoting at least one of said walls about an edge parallel to the plane of the primary strap loop to provide clearance around a portion of the periphery of said loop to permit expansion of the loop to said predetermined size.

11. The method of claim 1 wherein the step of forming a primary strap loop includes feeding a length of strap between two axially aligned adjacent guide rings.

12. The method of claim 11 including the additional step of pivoting each guide ring away from said primary strap loop to provide clearance around the periphery of said loop to permit expansion of the loop to said predetermined size.

13. The method of claim 1 wherein the step of forming a primary strap loop includes feeding a length of strap on the inside of a flexible member which is maintained in an arcuate configuration.

14. The method of claim 13 including the additional step of pulling one end of said flexible member increasingly away from the center of said primary strap loop whereby said flexible member is peeled away from said loop to provide clearance around the periphery of said loop to permit expansion of the loop to said predetermined size.

15. The method of claim 1 wherein the step of forming a primary strap loop includes holding the free end of a length of strap and moving said free end in a closed path to orient one strap side on the free end adjacent and facing the opposite strap side on said overlapped portion.

16. The method of claim 15 wherein the step of holding the free end of a length of strap includes restraining said free end in a slot on a rotatable holding member.

17. The method of claim 16 wherein the step of moving said strap end in a closed path includes rotating said holding member greater than $2\pi$ radians.

18. The method of claim 1 wherein the step of restraining said free end of the strap includes pressing said free end and said overlapped portion of the strap loop between a rough-surfaced member contacting a side of said free end and a smooth-surfaced member contacting a side of the overlapped portion of the strap loop.

19. The method of claim 1 wherein the step of effecting relative movement between said package and the expanded loop includes the steps of first restraining an area of the expanded loop and then twisting the balance of the loop about said area and out of the plane of loop formation to locate the loop about said package.

20. The method of claim 19 wherein the step of first restraining the loop includes pressing said free end and an overlapped portion of the loop between a rough-surfaced member contacting a side of said free end and a smooth-surfaced member contacting a side of the overlapped portion of the strap loop.

21. A method of forming a strap loop and securing it about a package comprising: feeding a length of strap in a strap guide; guiding the free end of the strap in said strap guide in a closed path to form a primary loop with a portion of said primary loop overlapped by said free end of the strap; gripping said free end of said strap to prevent further movement of said free end; effecting relative movement between said primary loop and said strap guide to provide clearance around the periphery of the loop while continuing to feed the length of strap to expand the loop to a predetermined diameter; effecting relative movement between said package and the expanded loop to locate the expanded loop about said package; tensioning said length of strap to tighten the loop around said package; joining said free end of the strap and an adjacent overlapped portion of the loop; and severing the standing portion of the strap from the tightened and connected loop.

22. The method of claim 21 wherein the step of effecting relative movement between said primary loop and said strap guide to provide clearance around the periphery of said primary loop includes maintaining said primary loop in a fixed plane while moving said strap guide out of said fixed plane.

23. A method of forming a strap loop and securing it about a package comprising: feeding a length of strap into a strap guide; guiding the free end of the strap in said strap guide in a closed arcuate path to form a primary loop with a portion of said primary loop overlapped by said free end of the strap; gripping said free end of the strap to prevent further movement of said free end; effecting relative movement between said primary loop and said strap guide to provide clearance around the periphery of said primary loop while continuing to feed the standing portion of strap to expand the loop to a predetermined diameter; inserting a package in the expanded loop drawing the loop tight around said package; friction welding said free end of the strap to an adjacent overlapped portion of the loop; and severing said standing portion of the strap from the tightened and welded loop.

24. A method of forming a strap loop and securing it about a package comprising:

feeding a length of strap in a closed path to form a primary strap loop with a portion of the strap loop overlapped by the free end of the strap; restraining said free end of the strap from further movement while continuing to feed the standing length of the strap to expand the loop to a predetermined size; effecting relative movement between said package and the expanded loop to locate the expanded loop about said package; and joining said free end of the strap and an adjacent overlapped portion of the loop.

25. A method of forming a strap loop and securing it about a package comprising:

forming a primary strap loop with a portion of the strap loop overlapped by the free end of the strap; restraining said free end of the strap from movement while feeding the standing length of strap to expand the loop to a predetermined size; effecting relative movement between said package and the expanded loop to locate the expanded loop about said package; and joining said free end of the strap and an adjacent overlapped portion of the loop.

* * * * *